United States Patent [19]

Aketa et al.

[11] Patent Number: 4,807,811

[45] Date of Patent: Feb. 28, 1989

[54] ACCUMULATOR FUEL INJECTOR FOR DIESEL ENGINE

[75] Inventors: Masahiro Aketa; Masahiro Yamashita; Satoshi Torii; Tetsuro Ikeshima, all of Sakaishi, Japan

[73] Assignee: Kubota Ltd., Osaka, Japan

[21] Appl. No.: 95,459

[22] Filed: Sep. 11, 1987

[30] Foreign Application Priority Data

Sep. 13, 1986 [JP] Japan ..... 61-216903
Sep. 13, 1986 [JP] Japan ..... 61-216901
Nov. 25, 1986 [JP] Japan ..... 61-280047

[51] Int. Cl.[4] ..... F02M 41/16; F02M 47/02

[52] U.S. Cl. ..... 239/91; 239/96; 123/447

[58] Field of Search ..... 239/5, 88, 90–94, 239/96, 553.4, 533.5, 533.7, 533.8; 123/299, 300, 447

[56] References Cited

U.S. PATENT DOCUMENTS 2,788,246 4/1957 Nichols ..... 239/96
2,959,360 11/1960 Nichols ..... 239/96
4,436,247 3/1984 Akagi ..... 239/533.7
4,513,719 4/1985 Edo ..... 239/96 X
4,561,590 12/1985 Akagi ..... 239/96

*Primary Examiner*—Andres Kashnikow
*Assistant Examiner*—Mary Beth O. Jones
*Attorney, Agent, or Firm*—Lowe, Price, LeBlanc, Becker & Shur

[57] ABSTRACT

The present invention relates to an accumulator fuel injector for a diesel engine, the device including first and second accumulators which are connected through a check valve and a relief valve. Fuel pressurized and delivered by a fuel injection pump is charged into the first accumulator so as to increase its pressure abruptly. When the fuel pressure in the first accumulator reaches a selected relief pressure, the fuel is charged into the second accumulator through the check valve and is accumulated therein. When fuel injection is started by opening of an injection valve, the fuel accumulated in the first accumulator is injected through the injection valve and at the same time the fuel accumulated in the second accumulator flows out to the first accumulator through the relief valve so as to also be injected through the injection valve. When the injection pressure decreases to the relief pressure at the end of the injection, the relief valve closes so that the fuel in the second accumulator is prevented from flowing into the first accumulator, and only the fuel accumulated in the first accumulator is injected.

4 Claims, 6 Drawing Sheets

ACCUMULATOR FUEL INJECTOR FOR DIESEL ENGINE

BACKGROUND OF THE INVENTION

1. Field of the Invention

The present invention relates to an accumulator fuel injector for a Diesel engine and, more particularly, to an accumulator fuel injector wherein an air-fuel mixing performance is enhanced by accumulating the fuel at an especially high pressure in an accumulator into which the fuel is adapted to be delivered from a fuel injection pump under a high pressure and then injecting the fuel from nozzle holes at that especially high pressure.

2. Background of the Prior Art

An accumulator fuel injector typically has a basic construction, for example as shown in FIGS. 1, 31 and 32. In a body 2,202,302 of an accumulator fuel injector 1,201,301 a fuel inlet 3,203,303 is connected in communication with nozzle holes through a valve closing pressure chamber 4,204,304, a check valve 5,205,305, an accumulator 6,206,306 and an injection valve 7,207,307 which is provided with a valve closing spring 9,209,309, a valve closing pressure receiving surface 10,210,310 and a valve opening pressure receiving surface 11,211,311. The injection valve 7,207,307 is pushed, on the one hand, toward the valve closing side by a resultant force comprising a tension force of the valve closing spring 9,209,309 and a pressure in the valve closing pressure chamber 4,204,304 acting on the valve closing pressure receiving surface 10,210,310 and, on the other hand, toward the valve opening side by a pressure within the accumulator 6,206,306 acting on the valve opening pressure receiving surface 11,211,311.

A accumulator fuel injector having such a basic construction functions as follows in order to enhance the fuel-air mixing performance by injecting the fuel at an especially high pressure.

(a) Accumulation Function

First of all, the fuel is sent pressurized into the valve closing pressure chamber 4 through the inlet 3 by a fuel injection pump 16 during its delivery stroke and then into the accumulator 6 through the check valve 5, and is compressed so as to be accumulated therein at an especially high pressure (for example 700–1500 Kg/cm). When the pressure in the valve closing pressure chamber 4 becomes equal to that in the accumulator 6 at the end of the delivery stroke of the pump 16, the check valve 5 is closed by a check valve spring 17.

To this point, since the valve closing force (which acts on the valve closing pressure receiving surface 10) and the valve opening force (which acts on the valve opening pressure receiving surface 11) are almost equal, the injection valve 7 is closed by force provided by the valve closing spring 9.

(b) Injection Starting Function

When the injection pump 16 makes it suction stroke, the pressure in the valve closing pressure chamber 4 decreases abruptly by escaping to the pump 16 and hardly acts on the valve closing pressure receiving surface 10. Thereupon, the valve opening force which acts on the valve opening pressure receiving surface 11 opens the injection valve 7 against the valve closing spring 9, so that the fuel accumulated at a high pressure in the accumulator 6 is injected through the nozzle holes 8 at a high pressure and expands.

(c) Injection Finishing Function

As the pressure in the accumulator 6 decreases as the fuel injection advances, the valve opening force which acts on the valve opening surface 11 also decreases gradually. When the pressure in the accumulator 6 decreases to a valve closing set up pressure Pc, the valve opening force which acts on the valve opening pressure receiving surface 11 gets smaller than the tension force of the valve closing spring 9. At that time, the fuel injection is finished as the injection valve 7 is closed by the valve closing spring 9.

In the accumulator fuel injector having such a typical basic construction, the accumulator 206,306 comprises only one accumulation chamber as shown in FIG. 31 (refer to U.S. Pat. No. 4,436,247) and FIG. 32 (refer to U.S. Pat. No. 4,561,590).

Accordingly, since the fuel injection pressure P varies linearly relative to the fuel injection quantity Q as shown in Diagram X of FIG. 5, the following problems are encountered therewith. That is, (1) the smaller the engine load becomes, or the further the injection advances, the sooner the injection pressure decreases, and (2) the fuel injection is carried out only intermittently during light load or no-load operation.

The reasons for those phenomena will now be explained. Generally, since the liquid fuel such as light oil used for a Diesel engine experiences a the volumetric strain under pressure, the pressure thereof varies proportionally relative to the quantity charged into a certain volume.

As shown in FIG. 5, when the maximum injection quantity Q of the fuel, the maximum injection starting pressure Pmax and the injection finishing pressure Pc (the valve closing set up pressure for the injection valve) are defined respectively, the maximum injection starting point A and the injection finishing point B are determined accordingly.

In the conventional embodiment as abovementioned, the relation between the fuel accumulation quantity and the accumulation pressure in the accumulator 206,306, namely between the injection quantity Q and the injection pressure P, is indicated as one linear line which connects the injection finishing point B and the maximum injection starting point A at FIG. 5 as shown in Diagram X. Therefore, the less the injection quantity Q becomes, or the further the injection advances, the sooner the injection pressure p decreases linearly when compared with the maximum injection starting pressure Pmax. Thereupon, the combustion performance soon becomes worse because the fuel atomization as well as the fuel spray penetration also deteriorate rapidly.

As known in the art of the injection valve 207, 307, the valve opening set up pressure Po is selected to be higher than the valve closing set up pressure Pc by the pressure corresponding to the differential area between the little smaller valve opening pressure receiving surface and the relatively larger valve closing pressure receiving surface.

While the pressure in the accumulator 206,306 increases from the valve closing set up pressure Pc to the valve opening set up pressure Po, the injection valve 207,307 is not opened and the fuel injection is not performed. In order to increase the pressure therein from the valve closing set up pressure Pc to the valve opening set up pressure Po, a certain charging quantity XQ is required for opening the valve 207,307.

During a no-load or a light load operation, there are some cases where one time charging fuel quantity which is charged from the injection pump 16 to the accumulator 206,306 becomes less than the valve opening charging quantity XQ. In this case, the pressure does not reach the valve opening set up pressure Po by such one time charging quantity, the fuel injection is not performed, and a misinjection is caused. When the pressure reaches the valve opening set up pressure Po after a plurality of chargings, all the fuel quantity charged heretofore is injected at a time.

In that manner, since the fuel injection is performed only intermittently, the angular velocity of the crank shaft varies seriously, the engine revolutions become unsteady, and in certain circumstances, the engine can not keep on running and may stall.

SUMMARY OF THE INVENTION

It is an object of the present invention to enhance the combustion performance in an engine by facilitating fuel atomization and fuel spray penetration by maintaining the injection pressure high even in the case of low injection quantity as well as in the case of advanced injection.

It is another object of the present invention to maintain steady engine revolutions continuously by injecting the fuel without fail whenever the fuel is charged into the accumulator from the injection pump, even in a no-load or a light load operation.

In order to accomplish the first and the second objects, the accumulator 6 in the basic construction is improved as follows in accordance to the present invention.

As best seen in FIGS. 1 through 5, the accumulator 6 comprises at least two separate accumulators of the first and the second accumulators 12, 13. The inlet of the first accumulator 12 is connected to the valve closing pressure chamber 4 through the check valve 5, and the outlet thereof is connected to the nozzle holes 8 through the injection valve 7. The first accumulator 12 is connected in communication to the second accumulator 13 through the check valve 14 and the relief valve 15 arranged in parallel. The relief pressure Pr is settled higher than the valve closing set up pressure Pc for the injection valve 7 exerted by the valve closing spring 9.

The present invention functions as follows, and the injection characteristic thereof is shown in Diagram Y of FIG. 5.

(1) The state after injection and before accumulation (refer to FIG. 1)

During the time from the finish of injection to the starting of accumulation, the pressure in the first accumulator 12 is kept at the valve closing set up pressure Pc exerted by the valve closing spring 9 so as to close the injection valve 7, and the pressure in the second accumulator 13 is kept at the relief pressure Pr settled by the relief valve 15. As shown in FIG. 5, the relief pressure Pr of the relief valve 15 is settled higher than the valve closing set up pressure Pc for the injection valve 7.

(2) The accumulation function (refer to the transit from FIG. 1 to FIG. 2)

The fuel is charged under pressure into the first accumulator 12 by the injection pump 16 during the latter's delivery stroke through the inlet 3, the valve closing pressure chamber 4 and the check valve 5, in that order. Since the volume of the first accumulator 12 is small, the pressure therein increases abruptly from the valve closing pressure Pc to the valve opening pressure Pr as shown in Diagram Y1 of FIG. 5. When the pressure in the first accumulator 12 surpasses the relief pressure Pr, the check valve 14 is opened thereby so that the fuel can be charged into the both first and second accumulators 12, 13. The total volume of both accumulators 12, 13 is large enough for the pressure therein to increase slowly from the relief pressure PR to the maximum injection starting pressure Pmax as shown in Diagram Yh of FIG. 5.

At the end of the delivery of the injection pump 16, the pressures in both the valve closing pressure chamber 4 and in the first accumulator 12 became equal, and thus the check valve 5 is closed by the check valve spring 17.

To this point, since the valve closing force which acts on the valve closing pressure receiving surface 10 and the valve opening force which acts on the valve opening pressure receiving surface 11 almost offset each other, the injection valve 7 is kept closed by the force of the valve closing spring 9.

(3) The injection starting function (refer to the transit from FIG. 2 to FIG. 3)

When the injection pump 16 takes the suction stroke, the pressure in the valve closing pressure chamber 4 decreases due to its escaping to the injection pump 16 rapidly and the valve closing force which acts on the valve closing pressure receiving surface 10 almost vanishes. As a result, the valve opening force which acts on the valve opening pressure receiving surface 11 opens the injection valve 7 against the force of the valve closing spring 9 so that the fuel which is accumulated in both the accumulators 12, 13 at a high pressure can be injected at the high pressure through the nozzle holes 8 and expand.

(4) The injection function (refer to FIG. 3)

As shown in Diagram Yh of FIG. 5, during the advancement of the fuel injection, the fuel in the first accumulator 12 is injected through the nozzle holes 8 for the main injection period QM when the pressure thereof decreases from the maximum injection starting pressure Pmax to the relief pressure Pr, as well as the fuel in the second accumulator 13 flows into the first accumulator 12 through the relief valve 15 and then it is injected through the nozzle holes 8. For the main injection period QM, since the total volume of both the accumulators 12, 13 is sufficiently large, the pressure therein decreases slowly. When the pressure decreases to the relief pressure Pr, the relief valve 15 closes so as to maintain the pressure in the second accumulator 13 at the relief pressure Pr as shown in Diagram Yc. As shown in Diagram Yl, while the pressure in the first accumulator 12 decreases from the relief pressure Pr to the valve closing set up pressure Pc, the relief valve 15 is kept closed so as to maintain the relief pressure Pr in the second accumulator 13 and the fuel is injected only from the first accumulator 12. For that duration, the pressure in the first accumulator 12 decreases abruptly because of its small volume.

(5) The injection finishing function (refer to the transit from FIG. 3 to FIG. 4)

When the pressure in the first accumulator 12 decreases to the valve closing set up pressure Pc, the valve opening force which acts on the valve opening pressure receiving surface 11 gets so much smaller than the tension force of the valve closing spring 9 that the valve closing spring 9 closes the injection valve 7 to finish the fuel injection.

Since the present invention functions as noted above, the following advantages can be obtained.

(1) As shown in Diagram Yh of FIG. 5, since the fuel is injected from the large total volume composed of the first and the second accumulators during the main injection period QM when the injection pressure decreases from the maximum injection starting pressure Pmax to the relief pressure Pr, the injection pressure decreases slowly.

Accordingly, even in the case that the fuel injection quantity is quite small, as during a partial load operation, and even in the case of a full load operation, the combustion performance can be enhanced by keeping the injection pressure high and thereby facilitating the fuel atomization as well as the fuel spray penetration.

(2) As shown in Diagram Yl, during the pressure increasing period PU when the pressure in the first accumulator is increased from the valve closing set up pressure Pc to the relief pressure Pr by the injection pump at its delivery stroke, the pressure in the first accumulator increases abruptly because the fuel is charged into the small volume composed of only the first accumulator. Therefore, the quantity YQo of valve opening charging fuel is required only a little for increasing the pressure from the valve closing set up pressure Pc to the valve opening set up pressure PO.

Accordingly, even in the case that the one time charging fuel quantity charged from the injection pump into the first accumulator is small during no-load through light load operation, since the pressure in the first accumulator surpasses the valve opening set up pressure Po by only a one time charging of the fuel thereinto, the injection valve is opened reliably every time there is fuel charging so that the engine can continue steady and reliable running. The foregoing and other objects and attendant advantages of the present invention will be readily appreciated as the same becomes better understood by reference to the following detailed description when considered with the accompanying drawings, wherein:

BRIEF DESCRIPTION OF THE DRAWINGS

FIGS. 1 through 4 are vertical sectional front views showing the operational sequence of the unit injector.

FIG. 1 shows the metered fuel feed stroke to the injection pump;

FIG. 2 shows the ineffective delivery stroke;

FIG. 3 shows the effective delivery stroke; and

FIG. 4 shows the return stroke.

FIG. 5 is a diagram showing the variation characteristics of fuel injection quantity and fuel injection pressure.

FIGS. 6-(1) through 6-(5) are diagrams showing the operational characteristics on the time proceeding of the respective parts of the unit injector.

FIG. 6-(1) shows the lift curve of the injection cam;

FIG. 6-(2) shows the lift curve of the injection valve;

FIG. 6-(3) shows the opening thereof;

FIG. 6-(4) shows the injection pressure thereof;

FIG. 6-(5) shows the rate of injection thereof.

FIG. 7 is a vertical sectional front view showing another embodiment of the unit injector.

FIG. 8 is a fuel system for the fuel metering and feeding device and the automatic injection timing device.

FIG. 9 is an explanatory view showing the cam profile of the injection cam.

FIG. 10 is a vertical sectional front view of the unit injector in the state prior to the fuel metering and feeding.

FIG. 11 is an explanatory view showing the profiles of the injection control valve ports provided in the plunger of the injection pump FIGS. 12-(1) through 12-(7) are diagrams showing the operational characteristics on the time proceeding of the respective parts of the unit injector.

FIG. 12-(1) shows the pressure in the spool accumulation chamber 41;

FIG. 12-(2) shows the lift of the spool 39;

FIG. 12-(3) shows the lift of the plunger 32;

FIG. 12-(4) shows the pressure in the plunger chamber 33;

FIG. 12-(5) shows the lift of the injection valve;

FIG. 12-(6) shows the pressures in the accumulators 12, 13; and

FIG. 12-(7) shows the rate of fuel injection;

FIGS. 13 through 18 are vertical sectional front views showing the operational sequence of the respective parts of the principal section of the unit injector.

FIG. 13 shows the state of fuel metering and feeding;

FIG. 14 shows the state of ineffective delivery of the injection pump;

FIG. 15 shows the state of first accumulation;

FIG. 16 shows the state of second accumulation;

FIG. 17 shows the state of injection starting;

FIG. 18 shows the state of main injection; and

FIG. 19 shows the fuel system for the automatic injection timing device different from that shown in FIG. 8.

FIG. 20 shows the fuel system for the fuel metering and feeding device, the automatic injection timing device and the unit injector.

FIG. 21 is a vertical sectional side view showing the fuel metering and feeding device integratedly combined with the automatic injection timing device.

FIG. 22 is a sectional view on line II—II in FIG. 21, showing a feed pump.

FIG. 23 is a sectional view on line III—III in FIG. 21, showing a pressure adjusting valve, an electromagnetic fuel shut-off vale and a manual fuel shut-off valve.

FIG. 24 is a sectional view n line IV—IV in FIG. 21, showing a forced delivery pump.

FIG. 25 is an enlarged view of the V-portion in FIG. 21, showing the automatic injection timing device.

FIG. 26 is a sectional view on line VI—VI in FIG. 25, showing a retraction pump.

FIG. 27 is a partially sectional perspective view of the VII-portion taken out from FIG. 25, showing the retraction pump.

FIG. 28 is a perspective view of the VIII-portion taken out from FIG. 25, showing a changeover valve and a timer.

FIG. 29 is a developed view of the IX-portion in FIG. 28, showing the operation of the changeover valve and the timer.

FIG. 30-(1) shows the stroke of feeding the metered fuel;

FIG. 30-(2) shows the stroke of ineffective delivery;

FIG. 30-(3) shows the stroke of effective delivery; and

FIG. 30-(4) shows the return stroke.

DESCRIPTION OF THE PREFERRED EMBODIMENTS

I. Accumulator Fuel Injector

Preferred embodiments of an accumulator fuel injector of the present invention will be described with reference to FIGS. 1 through 5 hereinafter.

Figure 1:
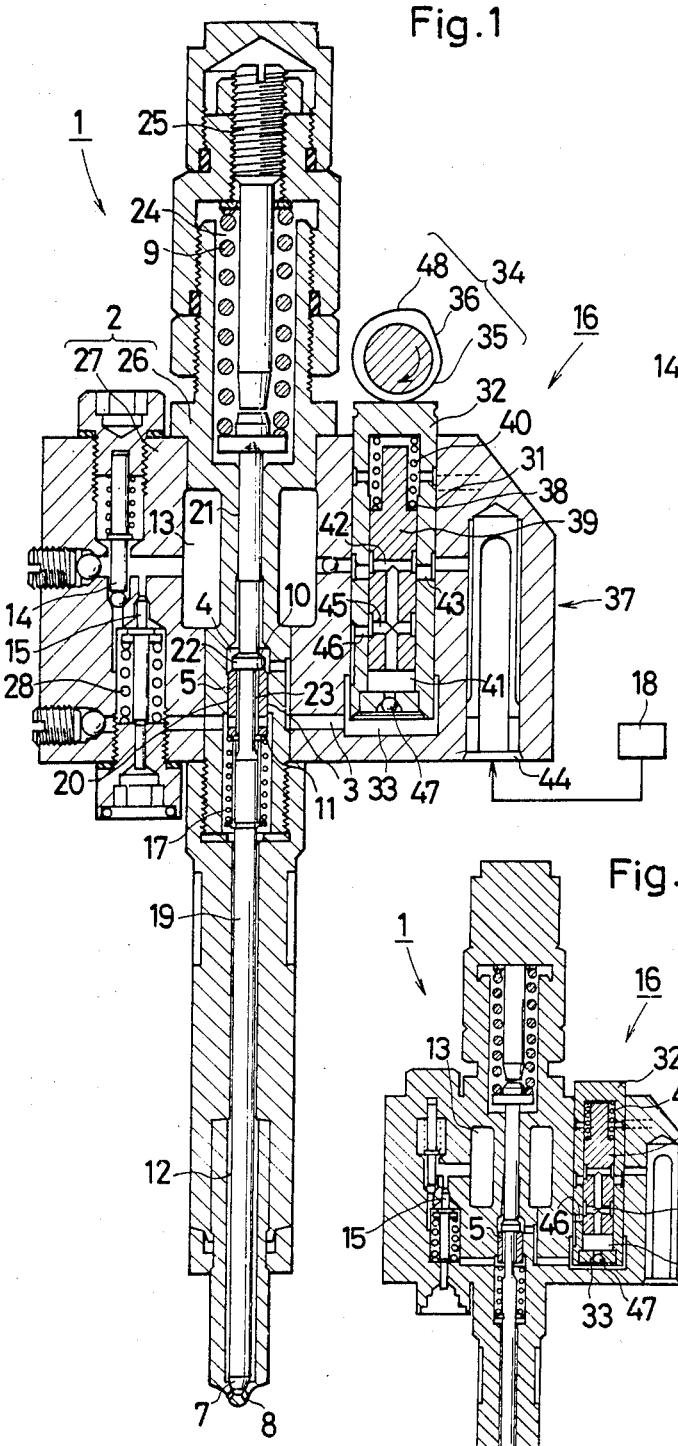
FIGS. 1 through 7 show, one embodiment of an unit injector integratedly composed of an accumulator fuel injector and a fuel injection pump for a Diesel engine according to the present invention.

As shown in FIG. 1, the fuel is adapted to be metered and fed by a metering and feeding device 18 to an injection pump 16, then charged into an accumulator fuel injector 1 by the injection pump 16 and finally injected into a combustion chamber through an injection valve 7 after being accumulated at a high pressure in the accumulator.

In the body 2 of the accumulator fuel injector 1, a fuel inlet 3 is connected in communication to nozzle holes 8 through a valve closing pressure chamber 4, a check valve 5, an accumulator 6, and the injection valve 7. The valve stem 18 of the injection valve 7 extends through the accumulator 6, the check valve chamber 20 and the valve closing pressure chamber 4 upwardly in order, and further extends slidably and air-tightly through a guide hole 21 provided in the upper wall of the valve closing pressure chamber 4. In the valve closing pressure chamber 4, a valve seat collar 22 for the check valve 5 is integratedly protruded from the valve stem 19. The check valve 5 is formed cylindrically and fitted to the outside of the valve stem 19 with keeping a fuel passing gap therebetween. Further, the check valve 5 extends slidably and air-tightly through the check valve chamber 20 and is pushed up so as to contact with the lower surface of the valve seat collar 22 for the check valve to close by a check valve spring 17. The injection valve 7 is provided with a valve closing spring 9, a valve closing pressure receiving surface 10 and a valve opening pressure receiving surface 11. The valve closing spring 9 is received in a spring chamber 24 formed in the upper portion of the injector body 2 and serves to resiliently force the upper end of the valve stem 19 downwards. The resilient force is adjusted by an adjusting screw 25. The valve closing pressure receiving surface 10 is formed by the upper surface of the valve seat collar 22 for the check valve. The valve opening pressure receiving surface 11 is formed by the lower surface of the check valve 5.

The injection valve 7 is pushed, on the one hand, toward the valve closing side by the resultant force of the tension force of the valve closing spring 9 and the pressure in the valve closing pressure chamber 4 which acts on the valve closing pressure receiving surface 10 and on the other hand, toward the valve opening side by the pressure in the accumulator 6 which acts on the valve opening pressure receiving surface 11.

The accumulator 6 actually comprises a first accumulator 12 and a second accumulator 13. The first accumulator 12 has a small volume and the second accumulator 13 has a relatively large volume. The inlet of the first accumulator 12 is connected to the valve closing pressure chamber 4 through the check valve 5, and the outlet thereof is connected to nozzle holes 8 through the injection valve 7. The second accumulator 13 comprises a cylindrical chamber coaxial with the guide hole 21. The injector body 2 is composed of an inner part 26 and an outer part 27 fitted air-tightly to each other. The second accumulator 13 is provided between the contact surfaces of the inner part 26 and the outer part 27. The first accumulator 12 is connected in communication to the second accumulator 13 through a check valve 14 and a relief valve 15 arranged in parallel. The relief pressure PR of the relief valve 15 is set by a relief valve spring 28 so as to be higher than the valve closing set up pressure for the injection valve 7 settled by the valve closing spring 9. At the left section of the outer part 27 there are provided the check valve 14 downwards and the relief valve 15 upwards respectively, and at the right section thereof there is provided a plunger hole 31 for the fuel injection pump 16, into which a plunger 32 is disposed from the upper side thereof.

Since the accumulator fuel injector 1 having the construction of the above-mentioned embodiment functions in accordance with the functions (1)-(5) in the above SUMMARY OF THE INVENTION, please refer thereto.

Additionally, in such a construction, since the volume of the first accumulator 12 is small and the volume of the second accumulator 13 is relatively large, the decreasing rate of the injection pressure becomes less so as to keep the injection pressure high during the main injection period QM. And, since the pressure increase rate becomes larger during the pressure increasing period PU and the quantity YQo of the valve opening charging fuel becomes less, mis-injection is never caused even in no-load operation.

The injector body 2 comprises the inner part 26 and the outer part 27 combined each other, the first accumulator 12 is formed in the inner part 26, and the second accumulator 13 is formed cylindrically between the contact surfaces of the inner and the outer parts 26, 27. Therefore, the distance from the axis of the injector 1 to the outer edge of the second accumulator 13 is so reduced that the size of the injector 1 can also be reduced. And the second accumulator 13 can be formed readily and accurately by fitting the outer peripheral surface of the inner part 26 and the inner peripheral surface of the outer part 27 so as to make a cylindrical cavity therebetween.

Further, in the outer part 27, there are provided the check valve 14, the relief valve 15 and the plunger hole 31 for the fuel injection pump 16 in parallel with the second accumulator 13, and the plunger 32 is put into the plunger hole 31. Therefore, since the outer part 27 can be made in a compact and simple shape by comparison with the whole of the injector body 2, the valve chambers of the check valve 14 and of the relief valve 15 and the plunger hole 31 can be manufactured readily and efficiently. And the check valve 14, the relief valve 15 and the plunger 32 can be set up readily and efficiently so as to reduce the manufacturing cost.

II. Injection pump

The injection pump 16 for charging the fuel into the accumulator fuel injector 1 of the present invention will now be explained with reference to FIGS. 1 through 4.

The plunger 16 of the injection pump 16 is pushed back toward the suction end position from the delivery end to the extent corresponding to the metered fuel quantity because the plunger chamber 33 is charged with the fuel quantity metered by the metering and feeding device 18 basically according to the engine load. The plunger 32 then charges the metered fuel into the accumulator fuel injector 1 from the plunger chamber 33 by being actuated to the delivery end position by the injection cam 34.

However, according to only this basic construction, since the plunger 32 is pushed back toward the suction end position from the delivery end position to the extent in correspondence to the metered fuel quantity, it does not return to the suction end position under the partial load operation of the engine. Accordingly, there is produced a gap between the plunger 32 and the base circle portion 35 of the injection cam 34, and the plunger 32 conflicts with the actuating curve portion 36 thereof. As a result, problems such as shocks and noise are caused intensively in the actuating system for the plunger 32.

The preferred construction is intended to solve the conflict between the plunger 32 and the actuating curve portion 36. That is, in order to prevent such generation of shocks and noise, there is provided a plunger push back device 37 in which the plunger 32 is pushed back to the suction end position by making use of the fuel pressure so that the plunger 32 can contact to the base circle portion 36.

The plunger push back device 37 is adapted to be set up in the plunger 32 and has the following construction.

A spool hole 38 is formed within the plunger 32 coaxially so as to accomodate a spool 39 vertically slidably and air-tightly therein. The spool 39 is biassed downwards by a push down spring 40 provided thereupon as well as upwards by the pressure in a spool accumulator 41 provided thereunder.

The spool accumulator 41 is connected to a fuel induction port 44 provided in the outer part 27 through an inlet 42 formed in the spool 39 and a communication hole 43 formed in the peripheral wall of the plunger 32. Accumulator 41 is connected to the plunger chamber 33 through an outlet 45 formed in the spool 39 and a valve port 46 formed in the peripheral wall of the plunger 32, and is also connected to the plunger chamber 33 through a check valve 47 provided in the lower wall of the plunger 32.

The injection pump 16 having the above-mentioned construction operates in the order as illustrated in FIGS. 1 through 4 and FIGS. 12-(1) through 12-(4) as follows.

Figure 30:
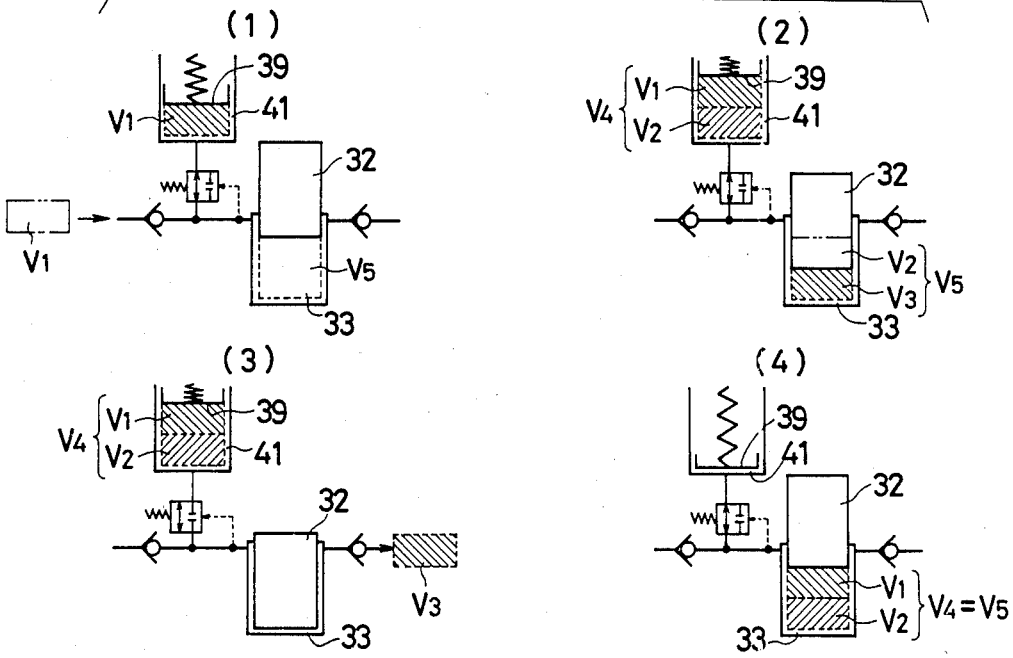
FIGS. 30-(1) through 30-(4) are explanatory views of the fuel systems showing the operation of the injection pump.

(1) The state of the returned plunger (refer to FIG. 1 and FIG. 30-(1))

FIG. 1 and FIG. 30-(1) show the state of the plunger 32 returned to the suction end position. When the contact portion of the injection ca 34 to the plunger 32 moves from the return curve portion 48 to the base circle portion 35, the spool 39 is pushed down by the push down spring 40 so that the fuel in the spool accumulator 41 is delivered to the plunger chamber 33. The plunger 32 is pushed up from the delivery end position to the suction end position so as to contact with the base circle portion 35.

The fuel $V_1$ metered by the metering and feeding device 18 is charged into the spool accumulator 41, and the spool 39 is pushed up on its halfway from the delivery end position to the suction end position.

Figure 2:
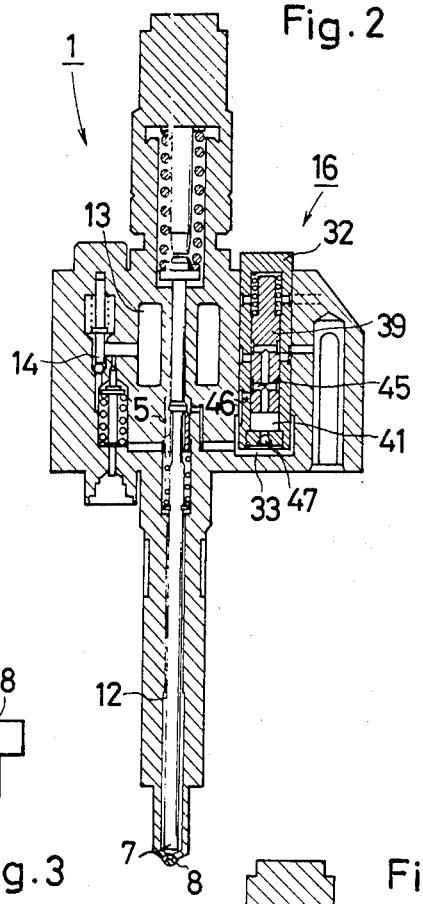

(2) Ineffective delivery (refer to the transits from FIG. 1 to FIG. 2 and from FIG. 30-(1) to FIG. 30-(2))

The revolution of the injection cam 34 advances so that the actuating curve portion 36 thereof actuates the plunger 32 from the suction end position to the delivery end position.

During the former half of the delivery stroke of the plunger 32, a portion $V_2$ of the fuel in the plunger chamber 33 flows backwards through the valve port 46 and the outlet 45 so as to be charged into the spool accumulator 41, and then pushes up the spool 39. When the spool 39 reaches its top dead center, the outlet 45 is closed thereby, because it has moved the valve port 46 to the topside thereof. In the meanwhile, since the fuel in the plunger chamber 33 escapes to the spool accumulator 41, the pressure therein does not increase enough for the fuel to be charged into the injector 1.

Figure 3:
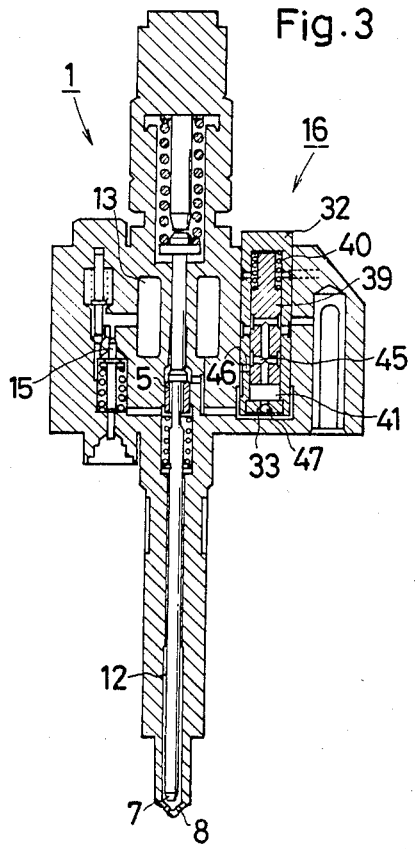

(3) Effective delivery (refer to the transits from FIG. 2 to FIG. 3 and from FIG. 30-(2) to FIG. 30-(3))

During the latter half of the delivery stroke of the plunger 32, the pressure in the plunger chamber 33 increases rapidly soon after the outlet 45 is closed so that the check valve 5 of the injector 1 is opened by surpassing the pressure in the first accumulator 12. The residual fuel $V_3$ in the plunger chamber 33 is charged pressurized into the first accumulator 12.

The charged fuel quantity $V_3$ is equal to the metered fuel quantity $V_1$ supplied from the metering and feeding device 18 to the spool accumulator 41. The reason for this is that the total delivery quantity $V_4$ by the spool 39 becomes equal to the total delivery quantity $V_3$ because the plunger 32 is pushed back over its full stroke by the total delivery quantity $V_4$ by the full stroke of the spool 39. In the "(2) ineffective stroke" as above-mentioned, since the quantity $V_2$ delivered from the plunger chamber 33 flows into the spool accumulator 41, the delivery quantity $V_2$ from the plunger chamber 33 is equal to the quantity $V_2$ that flows into the spool accumulator 41. Therefore, the delivery quantity $V_3$ of the effective stroke corresponding to the residual quantity obtained by deducting the delivery quantity $V_2$ of the ineffective stroke from the total delivery quantity $V_5$ of the plunger 32 is equal to the metered fuel quantity $V_1$ corresponding to the residual quantity obtained by deducting the flown in quantity $V_2$ of the ineffective stroke from the total delivery quantity $V_4$ of the spool 39.

Figure 4:
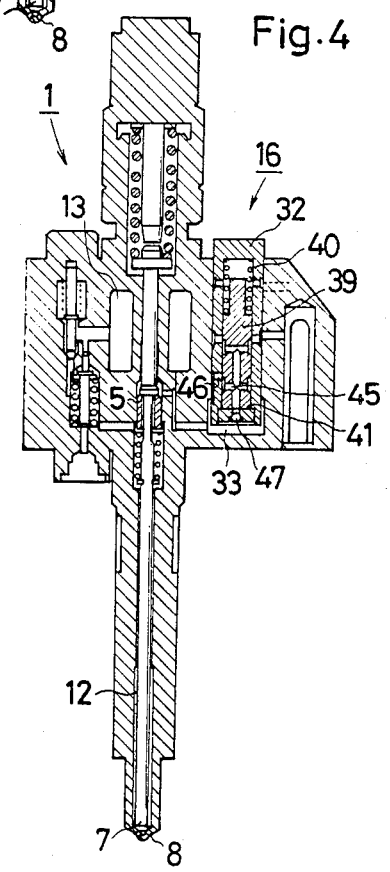

(4) Return stroke (refer to the transits from FIG. 3 to FIG. 4 and from FIG. 30-(3) to FIG. 30-(4))

When the injection cam 34 rotates from the actuating curve portion 36 to the return curve portion 48, the plunger 32 is not pushed up any more by the injection cam 34. At that time, the pressure in the plunger chamber 33 decreases rapidly, the check valve 47 is opened by the pressure in the spool accumulator 41, and the spool 39 is pushed down by the tension force of the push down spring 40. Then, the fuel corresponding to the total delivery quantity $V_4$ of the spool accumulator 41 is charged into the plunger chamber 33 at first only through the check valve 47 and after that through both of the check valve 47 and the valve port 46 so as to push up the plunger 32 to contact the return curve portion 48.

When the injection cam 34 further rotates from the return curve portion 48 to the base circle portion 35, the spool 39 reaches the delivery end position and the plunger 32 moves up to the suction end position so as to contact to the base circle portion 35.

After that, when the fuel metered by the metering and feeding device 18 is charged into the spool accumulator 41, as shown in FIG. 1 and FIG. 30-(1), the spool 39 is pushed up on the halfway to the suction end position so as to return to "(1) The state of the returned plunger" as mentioned above.

Figure 7:
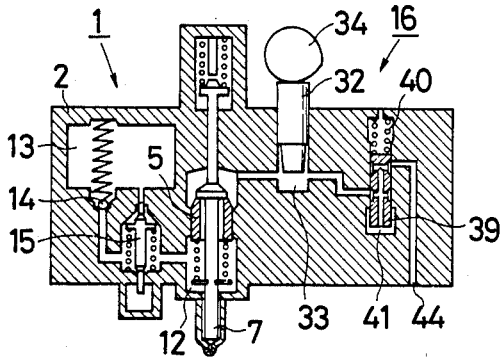

The spool hole 38 which is formed within the plunger 32 in the above characteristic construction as shown in FIG. 1 can also be formed within the injector body 2 as shown in FIG. 7, in another variation .

III. Injection Cam

Novel aspects of the shape of the return curve portion 48 of the injection cam 34 which actuates the injection pump 16 will be explained hereinafter.

Figure 6:
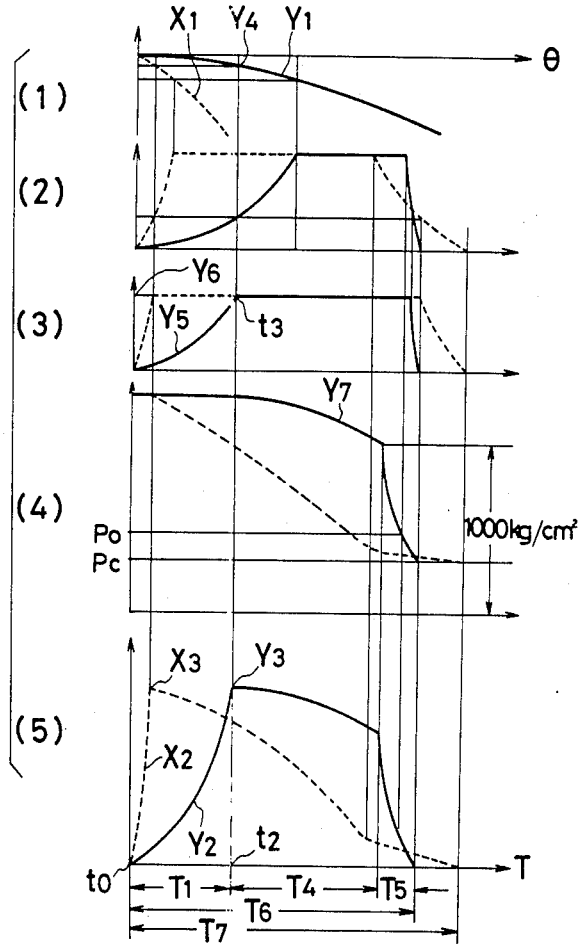

In the fuel injection cam for the accumulator fuel injector, as for a prior shape of the return curve portion 48, the prior art includes the one shown in FIG. 6-(1). By making the shape $X_1$ of the return curve portion in a large variation rate, it is intended that the pressure in the valve closing pressure chamber 4 be decreased rapidly through the plunger chamber 33 and the injection lag is made as short as possible.

In this case, as shown in Diagram $X_2$ of FIG. 6-(5), since the rate of injection increases rapidly and gets to the peak $X_3$ thereof much earlier than the ignition time $t_2$ of the end of the ignition lag $T_1$, at the ignition time $t_2$ has been already injected much fuel. Therefore, diesel knockings are apt to be caused because explosive combustion advances too rapidly soon after the fuel ignites at the ignition time $t_2$ and the pressure in the combustion chamber increases violently.

In the preferred embodiment, the shape of the return curve portion 34 is made in a return curve profile $y_1$ which has a suitably small variation rate, as shown in FIG. 6-(1), in order to prevent such diesel knockings.

The return curve profile $Y_1$ having a suitably small variation rate applied to the return curve portion 34 in this embodiment is defined as follows.

That is, as shown in FIG. 6-(1) and 6-(3), the lift thereof decreases progressively slowly over the phase $Y_4$ corresponding to the ignition lag $T_1$ from the fuel injection starting time to the ignition time $t_2$ at the rated engine revolution speed, and the profile $Y_1$ is defined in such a one which limits the position to which the plunger 32 is pushed back toward the suction end position from the delivery end position so that the valve opening effective area $Y_5$ of the injection valve 7 of the injector 1 becomes nearly equal to the total opening effective area $Y_6$ of the nozzle holes 8 at the phase $Y_4$ corresponding to the ignition time $t_2$.

The return curve portion 48 of the return curve profile $Y_1$ according to this embodiment functions as follows.

(1) The state of the finished pressure accumulation (refer to FIG. 2)

In the state of the finished pressure accumulation, wherein the plunger 32 is fully pushed to the delivery end position by the actuating curve portion 36 and the charging of fuel in the plunger chamber 33 into the accumulator 6 is finished, since the pressure in the valve closing pressure chamber 4 and the pressure in the first accumulator 12 are equal each other, the valve closing force which acts on the valve closing pressure receiving surface 10 and the valve opening force which acts on the valve opening pressure receiving surface 11 are offset from each other and the injection valve 7 is kept closed by the tension force of the valve closing spring 9 as the result.

(2) injection Starting (refer to FIG. 3)

When the injection cam 34 advances to the return curve portion 48 thereof, since the high pressure fuel in the plunger chamber 33, the inlet 3 and the valve closing pressure chamber 4 lifts up the plunger 32 with pushing it along the return curve portion 48, the high pressure fuel progressively decreases its pressure with enlarging the volume of the plunger chamber 33 so as to decrease the valve closing force which acts on the valve closing pressure receiving surface 10.

This keeps the injection valve 7 closed until the pressure in the valve closing pressure chamber 4 decreases by the pressure corresponding to the extension force of the valve closing spring 9. But, as it decreases to a valve lower than the pressure corresponding to that extension force, the high pressure fuel in the first accumulator 12 and the second accumulator 13 pressurizes the valve closing pressure chamber 4, the inlet 3 and the plunger chamber 33 through the valve opening pressure receiving surface 11, the check valve 5, the valve seat collar 22 for the check valve 5 and the valve closing pressure receiving surface 10 so that the injection valve 7 is opened thereby. The opening speed of the injection valve 7 is in proportion to the volume increasing speed of the plunger chamber 33 and determined according to the return curve profile $Y_1$ of the return curve portion 48 of the injection cam 34.

(3) The fuel injection during ignition lag period (refer to FIGS. 6-(1) through 6-(5))

As shown in FIGS. 6-(1) through 6-(5), in the return curve profile of this embodiment, the time $t_3$ when the valve opening effective area $Y_5$ of the injection valve 7 gets equal to the total valve opening effective area $Y_6$ of the nozzle holes 8 gets nearly the same as the ignition time $t_2$ at the end of the ignition lag period $T_1$ at the rated engine speed as shown in FIGS. 6-(2) and 6-(3).

Therefore, as shown in FIG. 6-(5), since the peak $Y_3$ of the rate of injection $Y_2$ gets nearly the same timing as the ignition time $t_2$ and the fuel quantity injected until the ignition time $t_2$ gets less by far than that in the case of the rate of injection $X_2$ in the prior art, the violent increase of the pressure in the combustion chamber immediately after the ignition is avoided and diesel knockings are unlikely to be caused.

Figure 5:
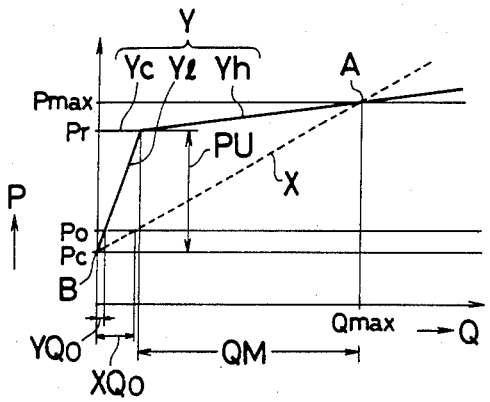

(4) The fuel injection after ignition (refer to FIG. 5 and FIGS. 6-(4) and 6-(5))

As described in "(4) The injection function" of "SUMMARY OF THE INVENTION", in the injector 1 of the present invention, the injection pressure P decreases rapidly as shown in Diagram Yl of FIG. 5 after decreasing slowly as shown in Diagram Yh.

Therefore, as shown in FIGS. 6-(4) and 6-(5), in the main injection period $T_4$, the injection pressure $Y_7$ is kept high, the rate of injection $Y_2$ is also kept high and the injection advances rapidly. After that, the injection pressure $Y_7$ decreases rapidly, the rate of injection $Y_2$ also decreases rapidly, and then the injection finishes in a short time $T_5$.

Accordingly, since the injection period $T_6$ is made much shorter than that $T_7$ in the prior art, the thermal efficiency can be enhanced and it becomes possible to attain a higher engine revolution speed.

IV Automatic Injection Timing Device

Novel features of the automatic injection timing device which controls the fuel injection timing automatically in proportion to the engine revolution speed will be explained with reference to FIGS. 8 through 18.

Figure 8:
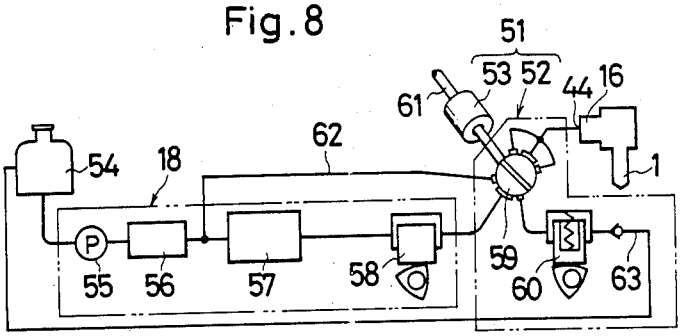

As shown in FIG. 8, the automatic injection timing device 51 is adapted to make the injection starting device 52 start the injection and to control the injection start timing of the injection starting device 52 by the timer 53.

Metering and Feeding Device

As shown in FIG. 8, the metering and feeding device 18 is constructed as follows.

The fuel in a fuel reservoir 54 is pressurized by a pump 55, the pressure of the fuel is controlled in proportion to an engine revolution speed by a pressure control valve 56, the feed quantity of the fuel is controlled in proportion to an engine load by a metering device 57, and then the fuel is charged into the injection pump 16 by a charging pump 58.

Injection Starting Device

As shown in FIG. 8, the injection starting device 52 serves to start the injection by decreasing the pressure in the valve closing pressure chamber 4 through the injection pump 16 by retracting the fuel !n the injection pump 16 to a retraction pump 60 through a changeover valve 59, and is constructed as follows.

The changeover valve 59 is provided between the charging pump 58 and the injection pump 16, and changeovers so as to connect the fuel induction port 44 of the injection pump 16 to the charging pump 58, to the retraction pump 60 and to a constant-pressure make-up passage 62 in order.

The retraction pump 60 returns the fuel sucked out of the injection pump 16 through the changeover valve 59 to a fuel reservoir 54 through a return passage 63 after being shut off from the injection pump 16 by the changeover valve.

Figure 9:
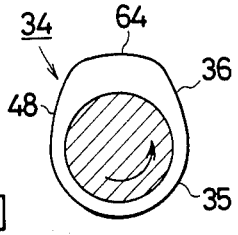

The constant-pressure make up passage 62 is connected to the outlet of the pressure control valve 22, and supplies the fuel pressure at the outlet of the pressure control valve 22 to the plunger chamber 33 of the injection pump 16 when it is connected to the injection pump 16 by the changeover valve 59 after the injection. As shown in FIG. 9, the injection cam 34 has a cam top arc portion 64 formed over relatively large rotational angle $\theta 1$ between the actuating curve portion 36 and the return curve portion 48. Over this rotational angle $\theta 1$ of the cam top arc portion 64, the fuel injection is carried out.

Figure 10:
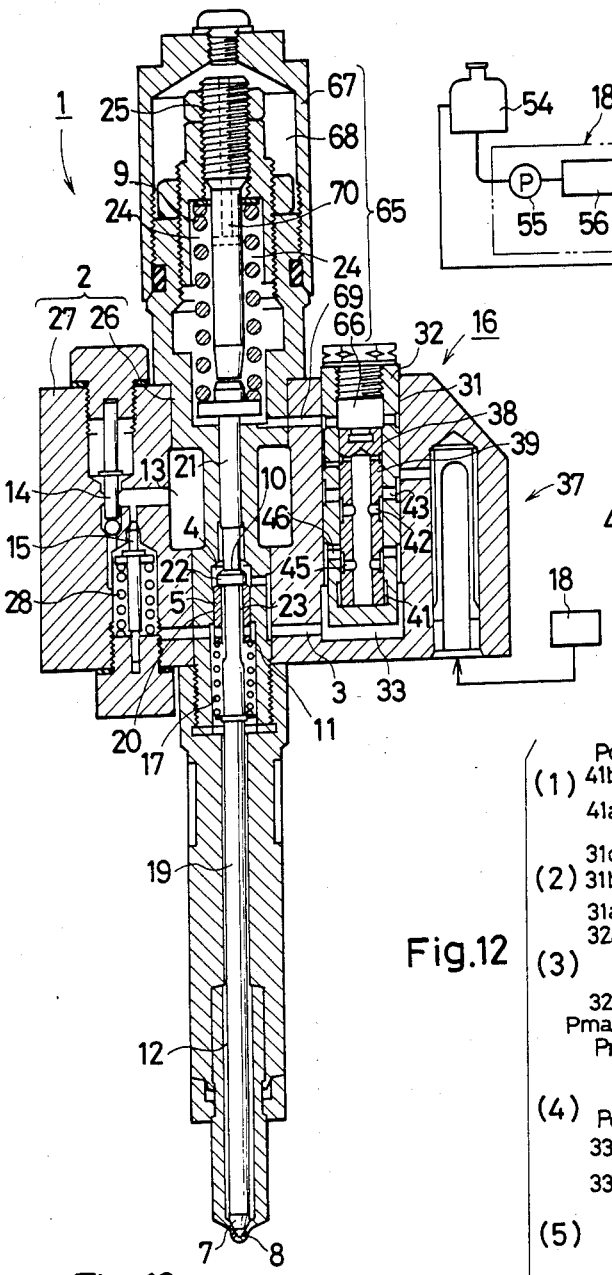
FIGS. 8 through 19 show a fuel metering and feeding device and an automatic injection timing device.

The injection pump 16 has a portion revised as shown in FIG. 10 in comparision with that shown in FIG. 1.

That is, instead of the push down spring 40 of the plunger 32, a fuel spring chamber 24 is utilized. The fuel spring chamber 65 comprises a bias chamber 66 provided at the upper side of the plunger 32, a spring chamber 24 for the valve closing spring 9 of the injection valve 7, a space within a cap 67 provided at the top end portion of the inner part 26 and connecting passages 69, 70 which connect both of the spring chamber 24 and the space 68 to the bias chamber 66. When the fuel spring chamber 65 is charged with pressurized fuel, it functions to push down the plunger 32 similarly as the push down spring 40 by the elastic restoration force which is produced by the pressurized fuel, so-called as a fuel spring.

Figure 11:
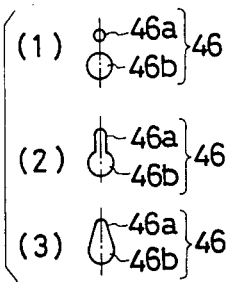

As shown in FIG. 11-(1), 11-(2) or 11-(3), the valve port 46 which performs the connection and the shutoff between the spool chamber 41 and the plunger chamber 33 comprises a small area portion 46*a* and a large area portion 46*b* which are arranged up and down respectively.

And the check valve 47 is omitted from the bottom wall section of the plunger 32.

Timer

As for the timer 53, one which has a well-known construction may be used, for example, one like a mechanical automatic timer in which the balancing force between a centrifugal weight and a spring is utilized.

Functions

Figure 12:
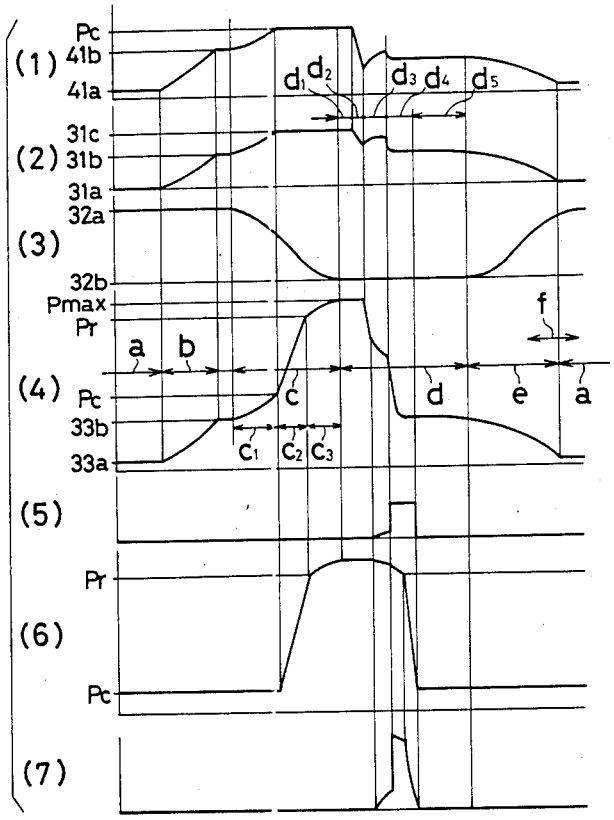

As shown in FIGS. 12-(1) through 12-(7), the automatic injection timing device 51 controls the injection timing in proportion to the engine revolution speed so as to set engine performance parameters such as output, fuel consumption, smoke, maximum combustion pressure, noise level, starting characteristic, exhaust gas characteristic, nitrogen oxides density and the like accurately to the best values from a general point of view by functioning as follows.

(1) Fuel Metering and Feeding Preparatory Period (refer to FIGS. 10 and 12)

A fuel metering and feeding preparatory period "a", as shown in FIG. 12, is defined as a period from the advancement of the injection cam 34 to the base circle portion 35 after the fuel injection to the beginning of the fuel metering and feeding.

During this period "a", the spool 41 is pushed down to the delivery end position 31*a* by the fuel spring accumurated in the fuel spring chamber 65, the plunger 32 is pushed up to the suction end position 32*a* by the fuel charged into the plunger chamber 33 from the spool accumulator 41, and each pressure in the spool accumulator 41 and in the plunger chamber 33 is decreased to an initial pressure 41*a*, 33*a* respectively.

Further, the injection valve 7 is closed by the valve closing spring 9, the check valve 5 is closed by the check valve spring 17, the first accumulator 12 is kept at the injection end pressure Pc, the relief valve 15 and the check valve 14 are closed, and the second accumulator 13 is kept at the relief pressure Pr.

(2) Fuel Metering and Feeding Period (refer to FIGS. 10 through 13)

During the fuel metering and feeding period "b", as shown in FIG. 12, the fuel metered by the metering and feeding device 18 is charged pressurized into the spool accumulator 41 through the changeover valve 59. The spool 39 is then pushed up to the metering and feeding position 31*b* at the halfway toward the suction end position 31*c* in proportion to the charged quantity so as to increase the pressures in the spool accumulator 41 and the plunger chamber 33 to the metering and feeding pressures 41*b*, 33*b*, respectively.

(3) Plunger Actuating Period (refer to FIGS. 13 through 16 and FIG. 12)

During the plunger actuating period c shown in FIG. 12, the plunger 32 is actuated downwards by the actuating curve portion 36 of the injection cam 34 from the suction end position 32*a* to the delivery end position 32*b*. The plunger actuating period "c" comprises the ineffective delivery period $c_1$, the first accumulation period $c_2$, and the second accumulation period $c_3$ in order.

During the ineffective delivery period $c_1$ (transiting from FIG. 13 to FIG. 14), the fuel delivered from the plunger chamber 33 is charged into the spool accumulator 41 through the valve port 46, then the spool 39 is pushed up to the suction end position 31*c* from the metering and feeding position 31*b*, and at that time the valve port 46 is closed. As the result, the pressures in the plunger chamber 33 and the spool accumulator 41 increase to the injection end pressure Pc from the metering and feeding pressures 33*b*, 41*b*.

During the first accumulation period $c_2$ (transiting from FIG. 14 to FIG. 15), the fuel delivered from the plunger chamber 33 passes through the inlet 3 and the valve closing pressure chamber 4 so as to open the check valve 5 by the pressure thereof, and is charged into the first accumulator 12. Accordingly, the pressures in the plunger chamber 33 and the first accumulator 12 increase from the injection end pressure Pc to the relief pressure Pr.

During the second accumulation period $c_3$ (transiting from FIG. 15 to FIG. 16), the fuel charged into the first accumulator 12 opens the check valve 14 by the pressure thereof and flows into the second accumulator 13 also. The pressures in the first and the second accumulators 12, 13 are thereafter increased to the maximum injection starting pressure Pmax from the relief pressure Pr in the case of full load operation.

(4) Plunger Holding Period (refer to FIGS. 16 through 18 and FIG. 12)

During the plunger holding period "d" in FIG. 12, the plunger 32 is held at the delivery end position 32*b* by the cam top arc portion 64, and the fuel injection is carried out by the operation of the injection starting device 52.

The plunger holding period "d" comprises the injection starting period $d_1$ when the injection is started, the ignition lag period $d_2$ when the early injection of a little fuel is carried out, and the main injection period $d_3$ when the main injection of major fuel is carried out.

During the injection starting period $d_1$ (transiting from FIG. 16 to FIG. 17), the fuel induction port 44 of the injection pump 16 is connected to the retraction pump 60 by the changeover valve 59. The fuel in the spool accumulator 41 is pushed out to the retraction pump 60 through the fuel induction port 44 and the changeover valve 59, and the pressure in the spool accumulator 41 begins to decrease. Accordingly, the spool 39 is pushed down from the suction end position 31*c*. When it is pushed down a little, only the small area portion 46*a* of the valve port 46 is opened so that the fuel in the plunger chamber 33 is jointed with the fuel from the spool accumulator 41 through the small area portion 46*a* and pushed out to the retraction pump 60. Consequently, the pressures in the plunger chamber 33 and the valve closing pressure chamber 4 start to decrease from the maximum injection starting pressure Pmax, and the valve closing force which acts on the vale closing pressure receiving surface 10 also decreases. And then the injection valve 7 is pushed up to start opening by the opening force which acts on the valve opening pressure receiving surface 11.

Figure 17:
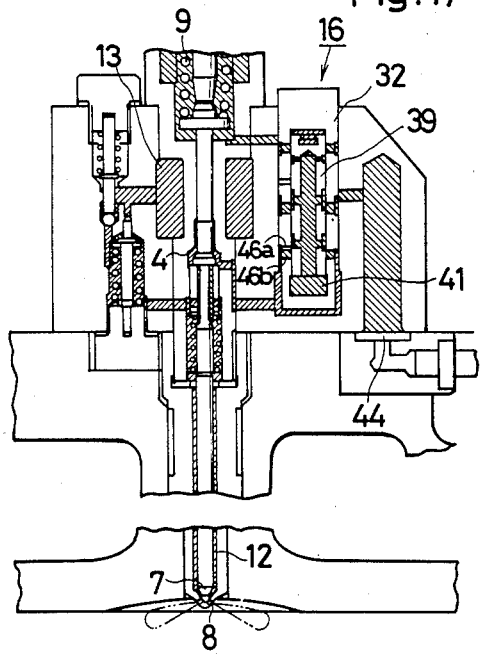
Figure 18:
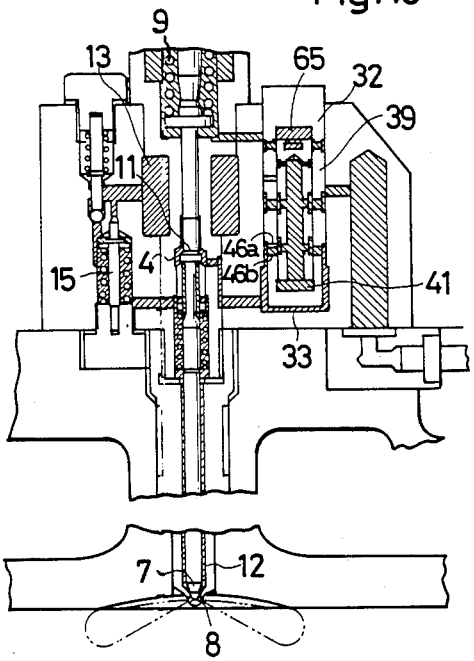

During the ignition lag period $d_2$ (being in the state as shown in FIG. 17), since the pressure in the valve closing pressure chamber 4 escapes slowly through only the small area portion 46*a*, the injection valve 7 is opened a little so that the fuel in the first and the second accumulators 12, 13 is injected at the small rate of injection through the nozzle holes 8. Therefore, the diesel knockings are prevented effectively.

During the main injection period $d_3$ (transiting from FIG. 17 to FIG. 18), as the pressure in the spool accumulator 41 still decreases by escaping to the retraction pump 60, the spool further moves downwards so as to open the large area portion 46*b* also. And then, since the pressure in the valve closing pressure chamber 4 decreases rapidly and the injection valve 7 is fully opened rapidly, the fuel is injected in large rate of injection from the first and the second accumulators 12, 13. When the injection gets near the end thereof and the pressures in the first and the second accumulators 12, 13 decrease to the relief pressure Pr, the relief valve 15 is closed so as to stop the delivery from the second accumulator 13. After that, the fuel injection is continued only from the first accumulator 12. When the injection pressure decreases to the injection end pressure Pc, the valve opening force which acts on the valve opening pressure receiving surface 11 decreases so that the injection valve 7 is closed by the valve closing spring 9.

After that, the changeover valve 59 shuts off the connection to the retraction pump 60 before the end of the plunger holding period d, and the retraction 60 delivers the retracted fuel to the fuel reservoir 54.

(6) Plunger Return Period (refer to FIGS. 10, 12 and 18)

During the plunger return period e in FIG. 12 (transiting from FIG. 18 to FIG. 10), the injection cam 32*a* advances to the return curve portion 48. The spool 39 is pushed down to the delivery end portion 31*a* by the fuel spring in the fuel spring chamber 65 so that the fuel in the spool accumulator 41 is charged into the plunger chamber 33. Therefore, the plunger 32 is returned to the suction end position 32*a* with being pushed to the return curve portion 48.

(7) Constant Pressure Make-up Period f (shown in FIG. 12)

When the plunger 32 is pushed back to the suction end position 32*a* at the end of the plunger return period "e", the pressures in the spool accumulator 41 and the plunger chamber 33 decrease lower by the pressure corresponding to the fuel quantity retracted by the retraction pump 60 than the initial pressure 41*a* during the fuel metering and feeding preparatory period a. Therefore, since the plunger 32 is not returned correctly to the suction end position 32*a* during the plunger return period e, the plunger 32 gets apart from the base circle 35. As the result, it is apprehended that the plunger 32 collides with the actuating curve portion 36 to produce shocks and noises. Further, it is apprehended that the next injection quantity gets short by that corresponding to the retracted fuel as well as the injection timing gets late correspondingly.

In order to solve these problems, the constant pressure make-up period "f" is provided in the neighborhood of the end of the plunger return period "e". During the constant pressure make-up period "f", the changeover valve 59 connects to the constant pressure make-up passage 62 so that the pressure controlled by the pressure control valve 56 can be supplied to the spool accumulator 41 and the plunger chamber 33 through the make-up passage 62 and the changeover valve 59 and then the pressures therein 41, 33 can be restored to the initial pressures 41*a*, 33*a* respectively. When finishing the restorations thereof, every cycle of the fuel injections is completed by everything returning to the initial "(1) Fuel Metering and Feeding preparatory period".

(8) Injection Timing Functions

The timer 53 controls the phase of the changeover valve 59 relative to the engine rotational shaft 61 in proportion to the engine revolution speed so that the timing of the retracting the fuel in the spool accumulator 41 to the retraction pump 60 is controlled and the timing of fuel injection from the injector 1 is controlled.

Figure 19:
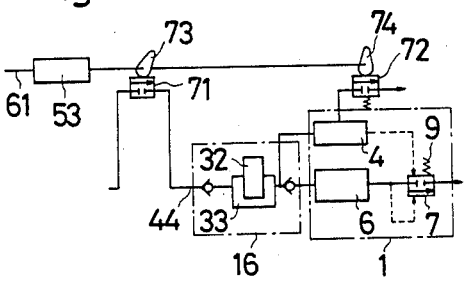
Figure 13:
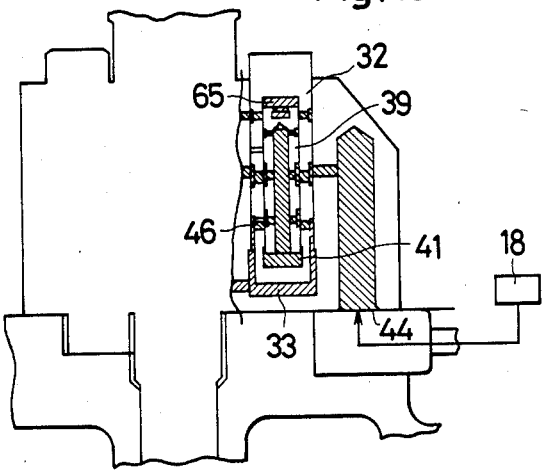
Figure 14:
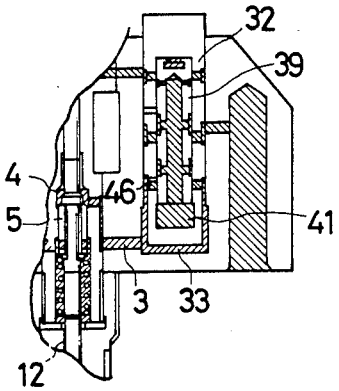
Figure 15:
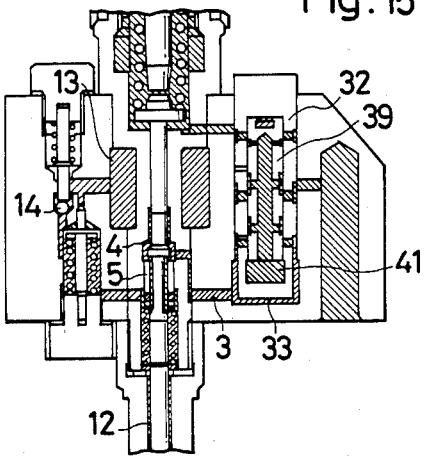
Figure 16:
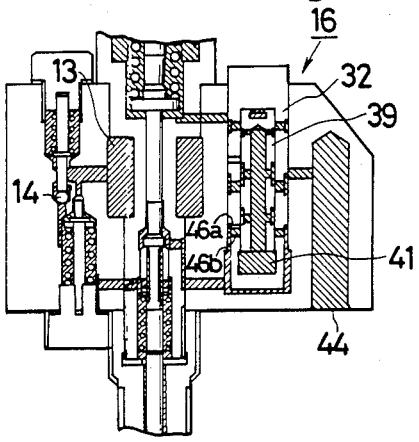

Instead of the changeover valve 59 shown in FIG. 8, two changeover valves 71, 72 shown in FIG. 19 in which the opening and the closing thereof is controlled by cams 73, 74 may also be used.

V. Concrete Construction of Metering and Feeding Device

Now the concrete construction of the metering and feeding device 18 shown in FIG. 8 will be explained with reference to the FIGS. 20 through 24.

Figure 20:
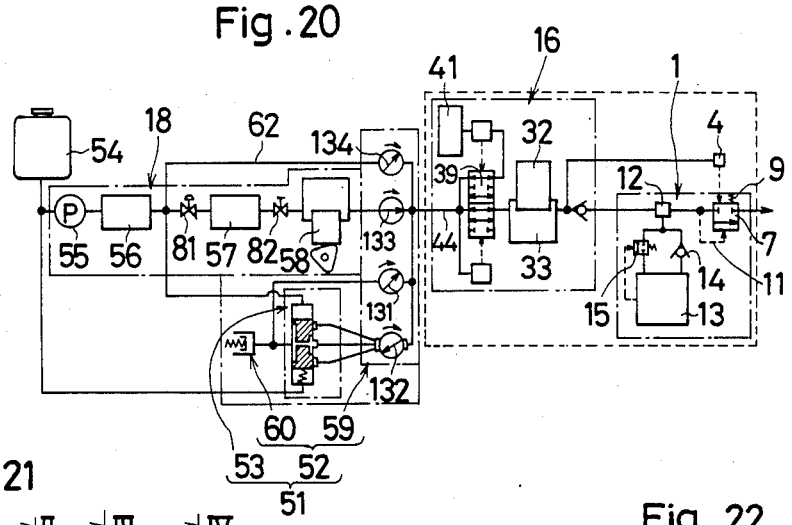
FIGS. 20 through 29 show the concrete construction improved from the fuel metering and feeding device and the automatic injection timing device shown in FIG. 8.

The construction as shown in FIG. 8 of the metering and feeding device 18 is converted as shown in FIG. 20. That is, an electromagnetic fuel shutoff valve 81 for stopping the engine is provided in the inlet side of the metering device 56, and a manual operating type fuel shutoff valve 82 for stopping engine is provided at the outlet side thereof additionally respectively. Accordingly, in the metering and feeding device 18, there are arranged the pressurizing pump 55, the pressure control valve 56, the electromagnetic fuel shutoff valve 81, the metering device 57, the manual operating type fuel shutoff valve 82 and the charging pump 58 in communication in order from the upper reaches to the lower reaches of the fuel supply.

Pressurizing Pump

Figure 21:
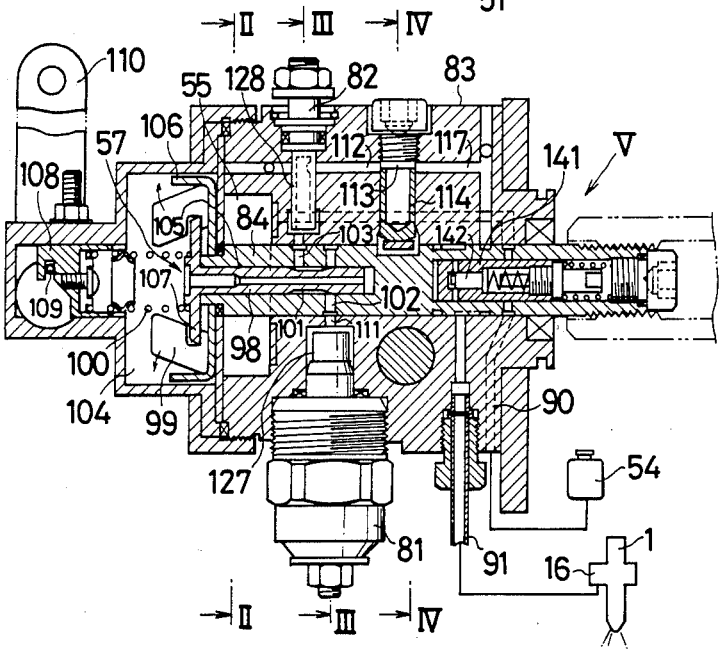
Figure 22:
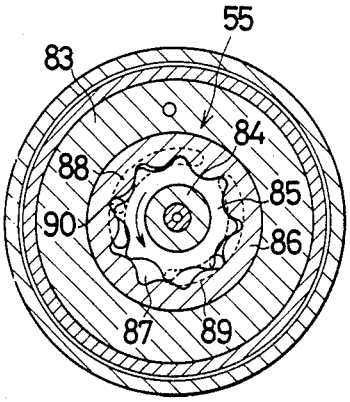

As shown in FIGS. 21 and 22, the pressurizing pump 55 comprises a trochoid pump, and is mounted in the fore half section of the thick wall cylindrical body 83 of the metering and feeding device 18. The pump 55 has a pump chamber 87 which changes its volume between an inner rotor 85 and an outer rotor 86 rotated by a main shaft 84 and which sucks the fuel from the intake port 88 and delivers it through its delivery port 89. The delivery pressure varies according to a quadratic function of the engine revolution speed.

The main shaft 84 is connected interlockingly in the ½ reduction gear ratio to the crank shaft of the engine through a transmission shaft 90. The intake port 88 is connected in communication to the fuel reservoir 54 through a suction passage 90 and a suction pipe 91.

Pressure Control Device

Figure 23:
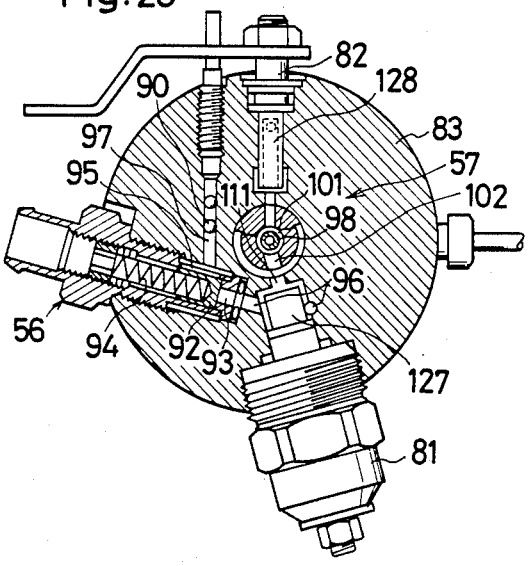

As shown in FIGS. 21 and 23, the pressure control device 56 is mounted in the intermediate section of the body 83, and relieves a portion of pressure in an inlet chamber 93 to a pressure relief valve port 95 by being controlled in its opening degree as its pressure control valve body 92 is pushed to a valve opening side against the valve closing spring 94 in proportion to the pressure in the inlet chamber 93 so that the pressure to which the delivery pressure from the pressurizing pump 55 is varied according to the quadratic function of the engine revolution speed as follows. That is, it controls such pressure so as to be varied according to a linear function of the engine revolution speed at the inlet chamber 93.

The inlet chamber 93 is connected to the delivery port 89 of the pressurizing pump 55 through the inlet passage 96. The pressure relief valve port 95 is connected to the suction passage 90 of the pressurizing pump 55 through its relief port 97.

Metering Device

As shown in FIGS. 21 and 23, the metering device 57 comprises a centrifugal governor and is mounted in the fore half sections of the body 83, 84. The metering device 57 is adapted to advance its metering valve body 98 against a governor spring 100 by a centrifugal force of the fly-weight 99 and to reduce a cross sectional area of a passage which connects a valve inlet port 102 and a valve outlet port 103 by a metering groove 101 provided in the periphery of the valve body 98 so that the fuel supply quantity is metered according to the engine load. That is, as the load becomes larger, the engine revolution decreases and the centrifugal force provided by the fly-weight 99 gets smaller. Thus, since the metering valve body 98 is caused to retreat by the governor spring 100 and the cross sectional area of the passage which connects the valve inlet port 102 and the valve outlet port 103 is enlarged by the metering groove 101, the fuel supply quantity is increased in proportion to the increase of the load.

The metering valve body 98 is fitted longitudinally slidably, rotatably and air-tightly into a valve chamber 105 from a governor chamber 104. The governor chamber 104 is formed in the front portion of the body 83. The valve chamber 105 is formed in the fore half section of the main shaft 84 coaxially therewith.

The fly-weight 99 is supported by a weight holder 106 within the governor chamber 104, and abuts against a flange 107 formed at the front end of the metering valve body 98 from the rear side thereof. The weight holder 106 is fixedly supported at the front end of the main shaft 84 so as to rotate therewith.

The governor spring 100 abuts against the flange 107 of the metering valve body 98 from the front side thereof, and its tension is adjusted by a speed control lever 110 through a spring holder 108 and an offset pin 109 so as to settle the engine revolution speed.

The valve inlet port 102 and the valve outlet port 103 are opened transversely with being arranged in the front and in the rear within the fore half section of the main shaft 84 so as to face the metering groove 101. The valve inlet port 102 connects to the inlet chamber 93 of the pressure control valve 56 through the inlet port 111 and the inlet passage 96.

Charging Pump

Figure 24:
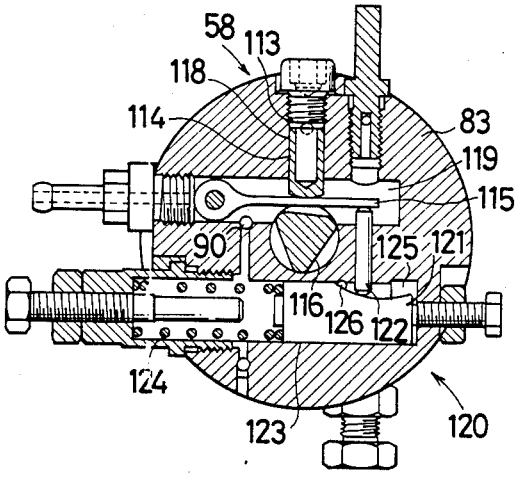
Figure 26:
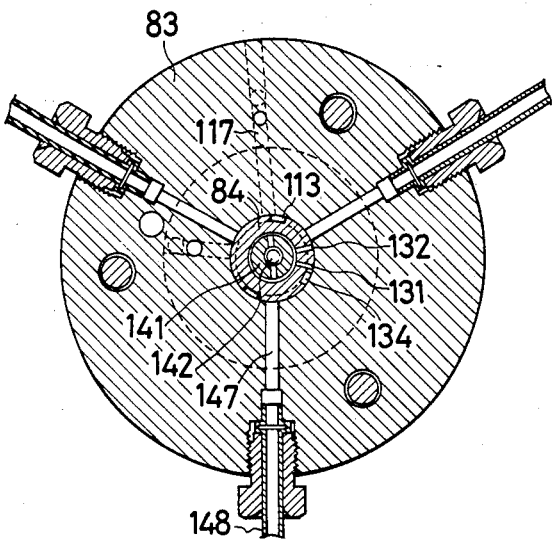
Figure 25:
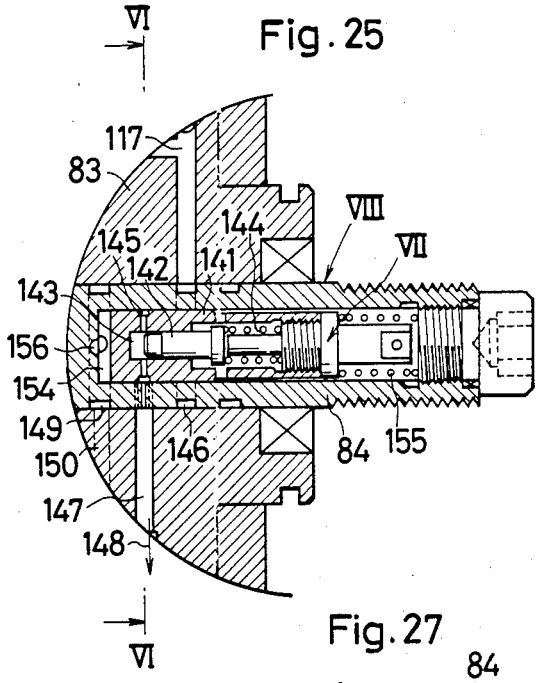
Figure 28:
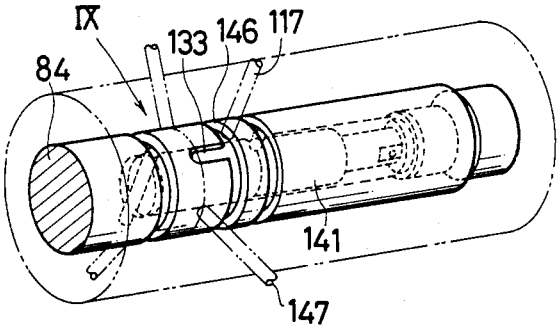
Figure 27:
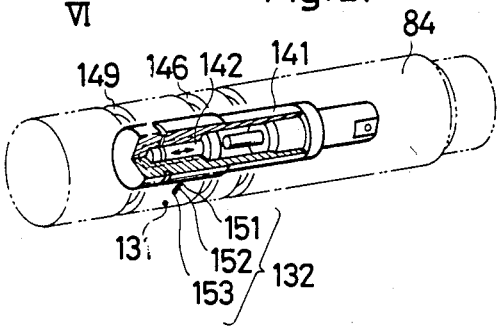
Figure 29:
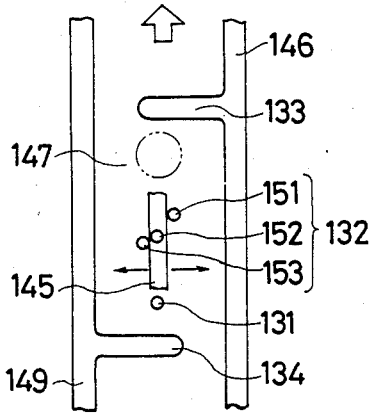
Figure 31:
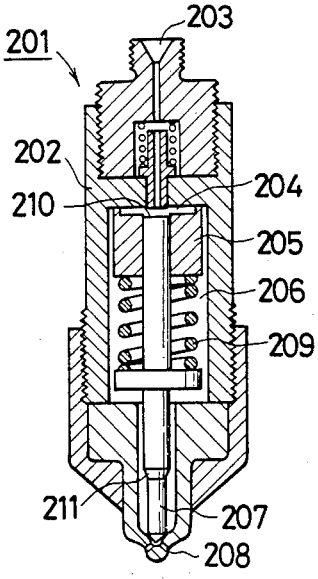
Fig. 31 (PRIOR ART)
FIG. 31 and FIG. 32 are vertical sectional front views of accumulator fuel injectors according to the prior art respectively.
Figure 32:
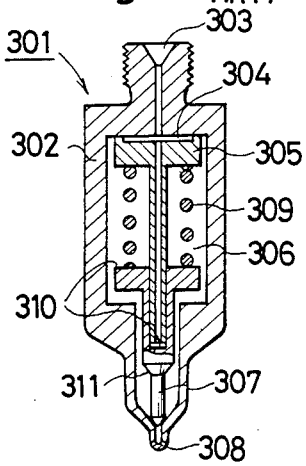
Fig. 32 (PRIOR ART)

As shown in FIGS. 21 and 24, the charging pump 58 comprises a piston pump and is mounted in the intermediate section of the body 83. As the fuel supplied from the metering device 57 in a pressurized state is charged into the pump chamber 113 from the valve outlet port 103 through the suction passage 112, the piston 114 is pushed down to perform its suction. When the piston 114 is pushed up by the cam 116 through the transmission lever 115, the charging pump 58 delivers the fuel within the pump chamber 113 to the delivery passage 117.

Within the upper half section at the intermediate in the longitudinal direction of the body 83, there is provided a cylinder bore 118 upwardly in which a piston 114 is provided to be reciprocating vertically so that the pump chamber 113 is formed at the upper side of the piston 114. The cam 116 is provided around the periphery of the main shaft 84 at the lower side of the piston 114. Between the cam 116 and the cylinder bore 118, there is provided a cam transmission chamber 119 in the left and right direction, in which the transmission lever 115 is provided vertically swingably.

The charging pump 58 is adapted to control the maximum torques relative to every engine revolution as the lift of the piston 114 is controlled by a torque curve set-up device 120. The torque curve set-up device 120 is adapted to adjust the lift of the piston 114 by adjusting the bottom dead center of the piston 114 by a direct actuation cam 121 through the transmission pin 122 and the transmission lever 115. The direct actuation cam 121 is put into the cam guide hole 123 air-tightly and slidably so as to be forced elastically toward its retreat side by the return spring 124 and be actuated toward its advance side by the pressure in the actuation chamber 125. The cam guide hole 123 is formed in the body 83 in the left and right direction at the lower side of the cam 116. The actuation chamber 125 is adapted to connect to the inlet chamber 93 of the pressure control chamber 56 through the communication port 126 and the inlet passage 96 so as to receive the fuel pressure controlled by the pressure control device 56.

Fuel Shutoff Valve

As shown in FIGS. 21 and 23, the electromagnetic fuel shutoff valve 81 is mounted within the lower half section at the intermediate in the longitudinal direction of the body 83 upwardly so as to be located at the halfway of the inlet passage 96 for the pressure control device 56 and control the opening and the closing of the valve inlet port 102 for the metering device 57 by the vertical movement of the valve body 127.

As shown in FIGS. 21 and 23, the manual operating type fuel shutoff valve 82 is mounted in the upper half section at the intermediate in the longitudinal direction of the body 83 downwardly so as to be located at the halfway of the suction passage 112 for the charging pump 58 and control the opening and the closing of the suction passage 112 by the reciprocative movement of the valve body 128.

VI. Concrete Construction of Automatic Injection Timing Device

Now the concrete construction of the automatic injection timing device 51 as shown in FIG. 8 will be explained with reference to FIGS. 20, 21 and 25 through 29 hereinafter.

The automatic injection timing device 51 is converted from the construction shown in FIG. 8 to that shown in FIG. 20. That is, the retraction pump 60 is revised from a cam actuating type to a fuel pressure actuating type. The retraction passage 63 of the retraction pump 60 is adapted to make up the fuel quantity corresponding to that retracted from the injection pump 16 to the retraction pump 60 by its connection being changeovered to the fuel induction port 44 for the injection pump 16 through the make-up port 131 in stead of the connection to the fuel reservoir 54, and avoids the shortage of the fuel corresponding to that retracted from the injection pump 16.

The changeover valve 59 progressively changeovers the connection of the fuel induction port 44 of the injection pump 16 to the metering groove 133, to the pressure relief valve port 132, to the make-up valve port 131, and to the constant pressure make-up groove 134 in order.

The timer 53 is revised from a mechanical type to a fuel pressure acutating type, and is located between the pressure relief valve port 132 of the changeover valve 59 and the retraction pump 60 in stead of between the engine rotational shaft 61 and the changeover valve 59.

Retraction Pump

The fuel pressure actuating type retraction pump 60 in FIG. 20 comprises a piston pump as shown in FIGS. 21, 25, 26 and 27, and is mounted within the main shaft 84 coaxially therewith. In the retraction pump 60, the piston 142 is adapted to be retreated to the pressure relief side in the cylinder 141 by the fuel pressure in the pump chamber 143 and to be advanced to the make-up side by the make-up spring 144. The outlet inlet peripheral groove 145 of the pump chamber 143 is formed on the outer periphery of the cylinder 141 so as to always connect to the pressure relief valve port 132 and to the make-up valve port 131.

Changeover Valve The changeover valve 59 in FIG. 20 comprises a rotary valve as shown in FIGS. 21, 25, 26, 28 and 29, and is provided between the contact surfaces of the body 83 and the main shaft 84.

On the outer periphery of the rear half section of the main shaft 84, there are provided a metering and feeding valve groove 133, a pressure relief valve port 132, a make-up valve port 131 and a the constant pressure make-up valve groove 134.

The metering and feeding valve groove 133 serves to connect the delivery passage 117 of the charging pump 58 to the fuel induction port 44 of the injection pump 44. That is, it is formed elongatedly in the lengthwise direction on the outer periphery of the main shaft 84 so that the rear portion thereof always connects to the delivery passage 117 of the charging pump 58 through the peripheral groove 146 and, also, the front portion thereof connects intermittently to the fuel induction port 44 of the injection pump 16 through the outlet port 147 and the discharge pipe 148. The outlet ports 147 are provided in the number corresponding to that of cylinder at the equally divided angle within the body 83, namely three outlet ports are provided for three cylinders engine as shown in figures.

The pressure relief valve port 132 and the make-up valve port 131 respectively connect the fuel induction port 44 of the injection pump 16 to the pump chamber 143 of the retraction pump 60. That is, they are provided radially in the main shaft 84 so that the inner end portions thereof always connect to the pump chamber 143 through the outlet inlet peripheral groove 145 of the retraction pump 60 and the outer end portions connect to the outlet port 147 only during passing over the outlet port 147.

The constant pressure make-up groove 134 serves to connect the outlet of the pressure control valve 56 to the fuel induction port 44 of the injection pump 16. It is formed elongatedly in the lengthwise direction on the outer periphery of the main shaft 84 so that the front portion thereof always connects to the inlet passage 96 of the pressure control valve 56 through the peripheral groove 149 and the communication passage 150 and the rear portion thereof connects intermittently to the fuel induction port 44 of the injection pump 16 through the outlet port 147 and the discharge pipe 148.

Timer

The fuel pressure actuating type timer 53 in FIG. 20 comprises a piston type timing valve as shown in FIGS. 21, 25, 26, 27, and 29. In the timer 53, the pressure relief valve port 132 comprises three injection timing valve ports 151, 152, 153 which are arranged obliquely around the main shaft 84 in such a manner as the rearmost one gets the position of the earliest injection timing, and within the main shaft 84, the cylinder 141 of the retraction pump 60 is retreated toward the early timing side by the fuel pressure in the early timing actuation chamber 154 as well as advanced toward the late timing side by the late timing spring 155.

The early timing actuation chamber 154 always connects to the inlet port 96 of the pressure control valve 56 through the communication port 156, the peripheral groove 149 and the communication port 150, and always receives the fuel pressure controlled in proportion to the engine revolution by the pressure control valve 56.

When the engine runs at a high rotational speed, the injection timing is controlled so as to perform early injection by retreating the cylinder 141 to the early timing side because the fuel pressure became high at the high engine speed, then connecting the outlet and inlet peripheral groove 145 of the retraction pump 60 to the valve port 151 positioned at the earlier timing side at the rear side, and then connecting the outlet port 147 to the pump chamber 143 of the retraction pump 60 at the earlier timing. To the contrary, when the engine revolution is low, the injection timing is controlled so as to perform the late injection by advancing the cylinder 141 toward the late timing side because the fuel pressure therein is low at the low engine speed, then connecting the outlet and inlet peripheral groove 145 to the valve port 153 positioned at the late timing side at the front side, and then connecting the outlet port 147 to the pump chamber 143 of the retraction pump 60. As the engine speed decreases on from the high range to the lower range, the injection timing is controlled so as to perform gradually the later injection by shifting from the condition wherein the outlet and inlet peripheral groove 145 connects to the valve port 151 at the earlier timing side to the condition wherein it connects only to the valve port at the later timing side via the conditions wherein it connects to over the both valve ports 151, 152 at the earlier timing side and at the intermediate timing side, and then to where it connects only to the valve port 152 at the intermediate side and then wherein it connects to over the both valve ports 152, 153 at the intermediate timing side and at the earlier timing side in order. To the contrary, as the engine speed increases from the low to the higher end of its range, the injection timing is controlled so as to perform the earlier injection by gradually shifting conversely.

We claim:

1. An accumulator fuel injector suitable for a diesel engine, having a fuel inlet connected in communication with at least one nozzle hole through a valve closing pressure chamber, a first check valve, an accumulator means and an injection valve in a body thereof, said injection valve being provided with a valve closing spring, a valve closing pressure receiving surface and a valve opening pressure receiving surface, and said injection valve being adapted to be pushed in a first direction toward a valve closing side by a net force comprising force exerted by the valve closing spring and pressure in the valve closing pressure chamber acting on the valve closing pressure receiving surface and in a second direction toward a valve opening side by a pressure within the accumulator means acting on the valve opening pressure receiving surface, characterized in that:

said accumulator means comprises at least a first accumulator and a second accumulator, an inlet of said first accumulator being connected to the valve closing pressure chamber through the first check valve and an outlet thereof being connected to the at least one nozzle hole through the injection valve, the first accumulator being connected in communication with the second accumulator through a second check valve and a relief valve arranged in parallel, wherein a relief pressure for the relief valve is higher than a valve closing set up pressure for the injection valve corresponding to the force exerted by the valve closing spring.

2. An accumulator fuel injector as recited in claim 1, wherein:

the volume of the first accumulator is smaller than the volume of the second accumulator.

3. An accumulator fuel injector as recited in claim 1, wherein:

the accumulator body comprises an inner part and an outer part fitted to contact air-tightly to each other, the first accumulator being formed within the inner part and the second accumulator being formed between contacting surfaces of the inner part and the outer part.

4. An accumulator fuel injector as recited in claim 3, wherein:

the outer part is provided with the second check valve, the relief valve and a plunger hole for a fuel injection pump operable in parallel with the second accumulator, and a plunger that is disposed into the plunger hole.

* * * * *